US008151710B2

(12) United States Patent
Fu et al.

(10) Patent No.: US 8,151,710 B2
(45) Date of Patent: Apr. 10, 2012

(54) SURFACE SHIP, DECK-LAUNCHED ANTI-TORPEDO PROJECTILE

(75) Inventors: Jyun-Horng Fu, Centreville, VA (US); Lance Hamilton Benedict, McLean, VA (US); Antonio Paulic, Arlington, VA (US); Robert M. Krass, Ashburn, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 251 days.

(21) Appl. No.: 12/057,123

(22) Filed: Mar. 27, 2008

(65) Prior Publication Data

US 2011/0297031 A1 Dec. 8, 2011

Related U.S. Application Data

(60) Provisional application No. 60/908,369, filed on Mar. 27, 2007.

(51) Int. Cl.
*F42B 15/22* (2006.01)

(52) U.S. Cl. ..... 102/399; 114/20.1

(58) Field of Classification Search ..... 102/398, 102/399, 517, 519; 114/20.1; 244/3.3
See application file for complete search history.

(56) References Cited

U.S. PATENT DOCUMENTS

| | | | | | |
|---|---|---|---|---|---|
| 1,371,207 | A * | 3/1921 | Wilkinson | 102/398 |
| 2,297,130 | A * | 9/1942 | Bomar | 244/3.27 |
| 3,282,216 | A * | 11/1966 | Calfee et al. | 244/159.1 |
| 3,292,879 | A * | 12/1966 | Seward | 244/3.3 |
| 4,569,300 | A * | 2/1986 | Ferris et al. | 114/20.1 |
| 5,223,667 | A * | 6/1993 | Anderson | 102/517 |
| 5,476,045 | A * | 12/1995 | Chung et al. | 102/529 |
| 5,744,748 | A * | 4/1998 | Mikhail | 102/523 |
| 5,929,370 | A * | 7/1999 | Brown et al. | 102/399 |
| 5,955,698 | A * | 9/1999 | Harkins et al. | 102/399 |
| 6,401,591 | B1 * | 6/2002 | Ross et al. | 89/1.13 |
| 6,405,653 | B1 * | 6/2002 | Miskelly | 102/374 |
| 6,601,517 | B1 * | 8/2003 | Guirguis | 102/473 |
| 6,739,266 | B1 * | 5/2004 | Castano et al. | 102/399 |

* cited by examiner

*Primary Examiner* — Bret Hayes
(74) *Attorney, Agent, or Firm* — DeMont & Breyer, LLC

(57) ABSTRACT

A surface ship, deck-launched anti-torpedo projectile is disclosed. The projectile has a blunt-end nose to create a cavitating running mode. The nose has a gradual, stepped, right-circular cylindrical or conic geometry. In some embodiments, the projectile includes a plurality of tail fins that are dimensioned and arranged to be within the generalized elliptical cavity that shrouds the projectile in the cavitating running mode.

20 Claims, 7 Drawing Sheets

.041± .002
6 places
.041± .002
6 places
922
.588 +.000 -.002
6 places
6 x 60°

A
2.308
5.503
.125 x 45°
CHAMFER
12 places
8.148 +.000 -.005
906
.779 ± .001
.484
.190 ± .001
A 0.500
4.000
0.688
2.308
906

922
906
930

SURFACE SHIP, DECK-LAUNCHED ANTI-TORPEDO PROJECTILE

CROSS REFERENCE TO RELATED APPLICATIONS

This case claims priority of U.S. Provisional Patent Application Ser. No. 60/908,369, which was filed on Mar. 27, 2007 and is incorporated by reference herein.

FIELD OF THE INVENTION

The present invention relates to a defense against high-speed torpedoes.

BACKGROUND OF THE INVENTION

The Shkval is a high-speed, supercavitating, rocket-propelled torpedo developed by Russia. It was designed to be a rapid-reaction defense against U.S. submarines undetected by sonar. It can also be used as a countermeasure to an incoming torpedo, forcing the hostile projectile to abruptly change course and possibly break its guidance wires.

The solid-rocket propelled torpedo achieves a high velocity of 250 knots (288 mph) by producing an envelope of supercavitating bubbles from its nose and skin, which coat the entire weapon surface in a thin layer of gas. This causes the metal skin of the weapon to avoid contact with the water, significantly reducing drag and friction.

The Shkval is fired from the standard 533-mm torpedo tube at a depth of up to 328 ft (100 m). The rocket-powered torpedo exits the tube at 50 knots (93 kmh) and then ignites the rocket motor, propelling the weapon to speeds four to five times faster than other conventional torpedoes. The weapon reportedly has an 80 percent kill probability at a range of 7,655 yd (7,000 m).

The torpedo is guided by an autopilot rather than by a homing head as on most torpedoes. Reportedly, there is a homing version of the Shkval that starts at the higher speed but slows and enters a search mode.

Notwithstanding its defense-motivated origins, the Shkval is potentially a very significant offensive threat. To date, no deck-launched anti-torpedo has been able to fulfill all of the above-mentioned requirements.

SUMMARY OF THE INVENTION

The illustrative embodiment of the invention is a deck-launched anti-torpedo projectile that is capable of:

stable flight in air;

water entry at a low grazing angle; and sustaining supercavitating running mode while in the water.

In accordance with the present invention, the anti-torpedo projectile comprises a blunt-end nose having a gradual, stepped geometry. In some embodiments, the nose has a gradual, stepped, substantially right-circular cylindrical geometry. In some embodiments, the nose has a gradual stepped geometry comprising sections that include at least one conic section. In some embodiments, the nose comprises at least one section having an inclined front face (i.e., a face whose surface is not orthogonal with the longitudinal axis of the section). In some of these embodiments, the inclined front face is within ±10 degrees of orthogonality with the longitudinal axis of the section. In some embodiments, the projectile includes a plurality of tail fins, preferably six or more. In some other embodiments, the barrel from which the projectile is fired is rifled. The center of gravity of the projectile is located as far forward as possible.

The blunt-end of the nose, in conjunction with the speed of the projectile (at least about 300 kilometer per hour), creates the "cavity." Specifically, at sufficient speed, the flat end of the nose forces water off the edge of the nose with such speed and at such an angle that the water avoids hitting the body of the anti-torpedo projectile. So, instead of being encased by water, the projectile is surrounded by an ellipsoidal region of water vapor. Although the blunt end of the nose has a high drag coefficient, the greatly reduced water contact area drastically reduces the overall projectile drag. As a consequence, the projectile retains greater velocity and travels further than non-supercavitating projectiles. To retain velocity as effectively as possible, the blunt end of the nose should be as small as possible while still producing a cavity which completely avoids hitting the body of the projectile.

For a projectile that enters water from the air, the shape of the projectile is important. In particular, if the projectile has a hemispherical nose or an ogival-shaped nose, it will tend to bounce off of the surface of the water. If the projectile has a substantially uniform diameter, as in a simple cylinder, it will tend to pitch down very sharply and veer to one side or the other. As a consequence, the projectile must possess certain physical adaptations to facilitate water entry at a low grazing angle.

The inventors have discovered that one suitable "correcting adaptation" for this problem is to use a stepped, substantially right-circular cylindrical geometry for the nose of the projectile. The "edges" provided by the right-angle steps are important to prevent the anti-torpedo projectile from bouncing off the surface of the water. And the relatively long nose is important not only to ensure that the entire nose geometry remains within the cavity, but also to ensure that the projectile does not pitch down too sharply. As a further design consideration, it has been discovered that when substantially right-circular conic sections are used in the nose of the projectile, the angle of each individual conic section should be less than the intended grazing angle, which is typically between about 2.5 to 7.5 degrees. Of course, the nose must be thick enough to withstand the stresses from water impact, etc. These factors, in conjunction with the required grazing angle, bound the design for the profile of the nose (i.e., the diameter and length for each step).

In-air stability of the blunt-nose, stepped anti-torpedo projectile is provided by either (1) the tail fins or (2) imparting adequate rotation to the anti-torpedo projectile, such as by "rifling" the barrel, in known fashion, from which the projectile is fired.

Initial tests with a typical tail fin arrangement (i.e., three or four fins providing a prescribed amount of surface) were unsuccessful. From analyzing these failures, it was conjectured that the tail fins were too "tall" to sustain the cavitating running mode. That is, the fins "clipped" or breeched the cavity that was shrouding the anti-torpedo projectile. The original tail fin arrangement was then redesigned to provide more tail fins (typically six) that were shorter in span (i.e., height) but longer in chord. The new tail fin arrangement therefore provided the requisite surface area, etc., based on aerodynamic considerations, as well as a profile that remained within the generalized elliptical cavity.

In some embodiments, the diameter of the aft portion of the body is reduced. This enables the use of tail fins with a greater height (i.e., a greater tail fin "span") while still remaining within the cavity.

If in-air stability is to be provided by rotation, then a relatively shorter, "stubbier" anti-torpedo projectile is used. For example, in some embodiments, an anti-torpedo projectile that does not incorporate tail fins is about ⅔ of the length of an anti-torpedo projectile that has tail fins. And the maximum width (which is at the tail end) of a tail-fin-free projectile is about 60 percent greater than maximum width of the body of an anti-torpedo projectile that has tail fins. When the tail fins are included in the determination of projectile width, the maximum width of the tail-fin-free (spin-stabilized) and the tail-fin-bearing (fin-stabilized) projectiles is about the same.

As previously indicated, the center of gravity of the anti-torpedo projectile should be as far forward as possible, the intent being to prevent the in-water projectile from tip-over. The position of the center of gravity is adjusted by appropriate selection of the materials of the nose and body section of the projectile (e.g., using a denser material in the nose will bring the center of gravity forward). For example, in some embodiments, the nose comprises tungsten and the body comprises bronze. In some other embodiments, the nose is tungsten and the body comprises aluminum. In yet some further embodiments, the nose comprises tungsten and the body comprises titanium. In some additional embodiments, the nose and body comprise steel.

DETAILED DESCRIPTION

Figure 1:
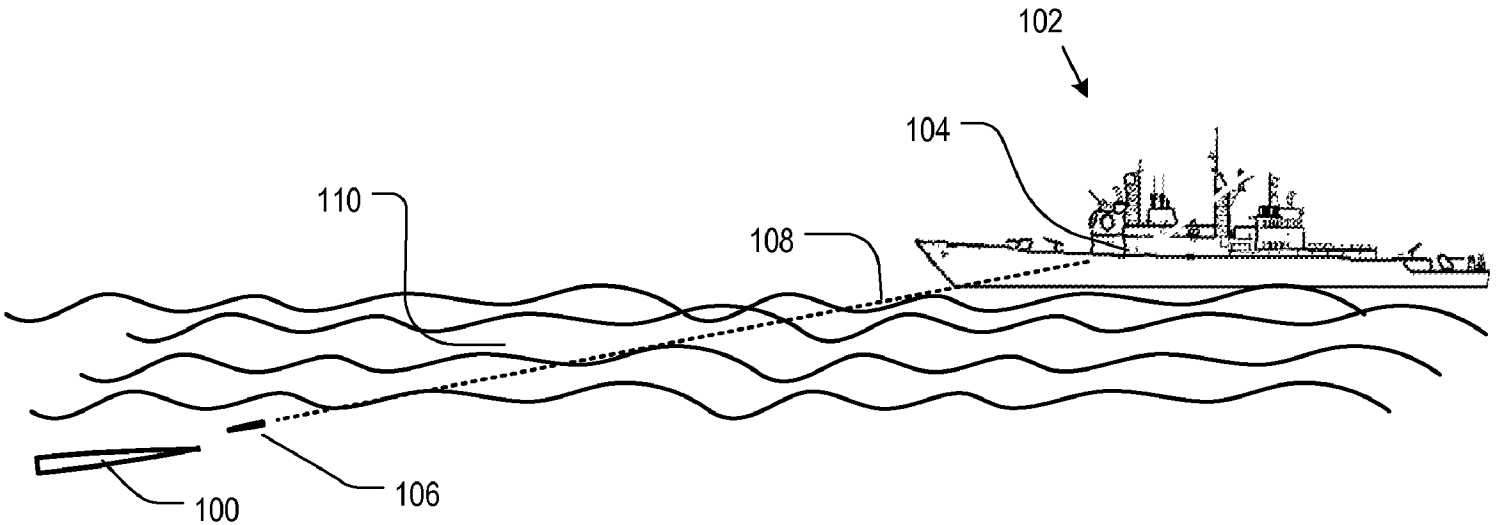
FIG. 1 depicts a deck-launched anti-torpedo projectile being fired to stop an incoming supercavitating torpedo.
Figure 2:
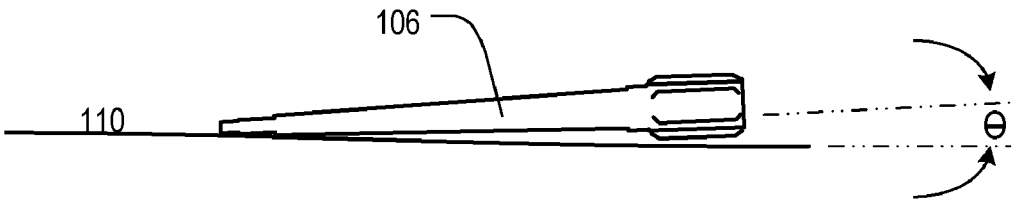
FIG. 2 depicts the anti-torpedo projectile entering the water at a shallow angle of entry.

FIG. 1 depicts deck-launch anti-torpedo projectile 106 being fired from ship cannon 104 aboard ship 102 to neutralize incoming cavity-running torpedo 100. Trajectory 108 of projectile 106 is such that the projectile enters the water 110 at a shallow grazing angle. FIG. 2 depicts this shallow grazing or water entry angle Θ. The shallow grazing angle is required to intercept incoming threat 100 at a sizable stand-off distance (e.g., 500 yards, etc.) from surface ship 102.

It is understood then, that to intercept a high-speed torpedo, a deck-launched anti-projectile must: (1) stably fly through air, (2) maintain integrity as it penetrates the surface of the water, (3) maintain trajectory (avoid pitch down, skipping, etc.) as it enters the water, and (4) move at high speed through water via a cavity-running mode. Furthermore, as previously indicated, the projectile (5) must be able to enter the water at a small grazing angle. An angle of water entry of between about 2.5 to about 7.5 degrees is determined by the torpedo standoff distance and the elevation difference between gun and torpedo.

The present inventors have discovered, through empirical studies, testing and analysis, that to satisfy these requirements, an anti-torpedo projectile should possess certain characteristics. In particular, a deck-launched anti-torpedo projectile that is capable of defeating a cavity-running torpedo in accordance with the illustrative embodiment of the present invention should possess the following characteristics:

- is fin or spin stabilized (for requirement 1);
- is constructed of suitably strong materials of appropriate diameter (for requirement 2);
- a stepped profile defined by a plurality of substantially right-circular cylindrical sections of increasing diameter or a stepped profile defined by a plurality of substantially right-circular conic sections of increasing diameter (for requirement 3);
- a forward center of gravity (for requirements 3, 4, and 5);
- a blunt nose (for requirements 3 and 4);
- suitable dimensions (e.g., ratio of nose diameter to body diameter, etc.) (for requirement 4);
- tail fins with a relatively smaller span and a relatively longer chord (for requirement 4),
- in some embodiments, including that of a stepped profile including substantially right-circular conic sections, the taper angle of each conic section should be less than the intended grazing (water-entry) angle (for requirement 5).

For the purposes of this specification, including appended claims, the term "substantially right-circular cylindrical section" means a section having a substantially uniform cylindrical cross-section whose front face (i.e., the exposed surface of the cylinder that faces toward the target) is within approximately ±10 degrees of orthogonality with the section's longitudinal axis. In similar fashion, the term "substantially right-circular conic section" means a conic section whose front face is within approximately ±10 degrees of orthogonality with the longitudinal axis of the section.

The cavity diameter $D_c$ is expressed as a function of supercavitating velocity $v_{sc}$ and projectile nose diameter $D_N$ from the following empirically determined expression:

$$D_c=(0.2133875+0.9100519v_{sc})\times D_N \quad [1]$$

It is evident that cavity-running mode operation is lost when the diameter $D_B$ of the projectile is equal to the diameter of the vapor cavity. Therefore, expression [1] can be written as:

$$D_B=(0.2133875+0.9100519v_{sc})\times D_N \quad [2]$$

Supercavitating velocity $v_{sc}$ can then be expressed in terms of the ratio of the diameter of the projectile's body to the projectile's nose:

$$V_{sc}=(1.0989[D_B/D_N]-0.2345)\times V_c \quad [3]$$

Where:

$V_c$ is given by $V_c=(2P/\rho_{water})^{1/2}$;

$\rho_{water}$ is the density of the water at the relevant temperature;

P is the static drag.

As a consequence, given the relevant diameters of the projectile, supercavitating velocity $V_{sc}$ can be determined. Or, given a requirement for supercavitating velocity (or range), then the projectile nose and body diameters can be determined.

Figure 3:
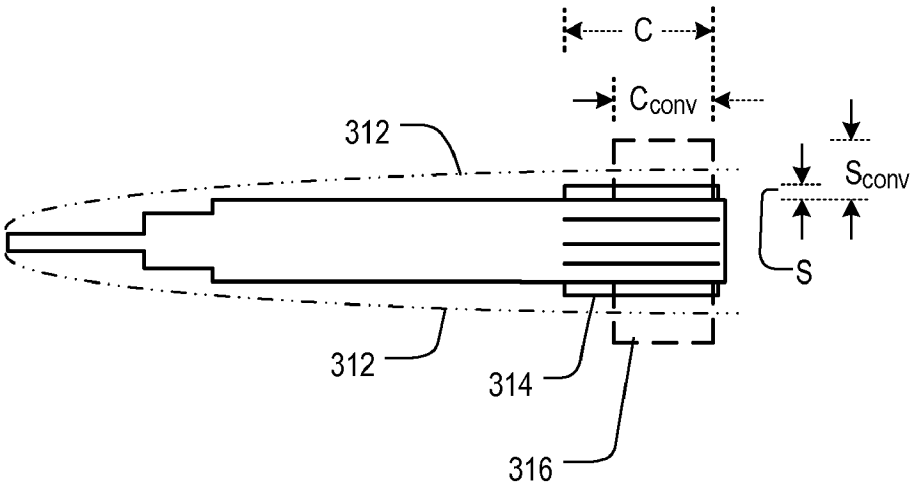
FIG. 3 depicts a comparison of tail fins having a relatively larger fin span with those having a relatively smaller fin span with regard to a cavity profile.

FIG. 3 depicts projectile 106 having fins 314, in accordance with the illustrative embodiment of the present invention. For comparison purposes, conventional fins 316 are depicted, via broken lines, on projectile 106. Vapor cavity 312, as is formed via supercavitation, is depicted enveloping projectile 106.

From post mortem analysis of testing, the inventors conjectured that conventional fins having a typical fin span, such as fins 316 having fin span $S_{conv}$, tended to breech cavity 312, thereby terminating cavity-running operation and causing catastrophic failure of the projectile. This problem was addressed by the use of fins 314, which have a relatively shorter span S but longer chord C than conventional fins 316. Fins 314 are designed such that fins span S is less than the cavity diameter $D_c$, as determined from expression [1]. A greater number of such modified fins 314 are used relative to conventional fins, as is necessary to provide the requisite fin surface area based on aerodynamic considerations.

It was further recognized that, to the extent that the diameter of the tail section of an anti-torpedo projectile is reduced, some of the fin span that was sacrificed for the sake of cavity running can be recovered. This concept is illustrated in FIG. 4, which depicts two anti-torpedo projectiles 406*a* and 406*b* in accordance with the illustrative embodiment of the present invention.

Figure 4:
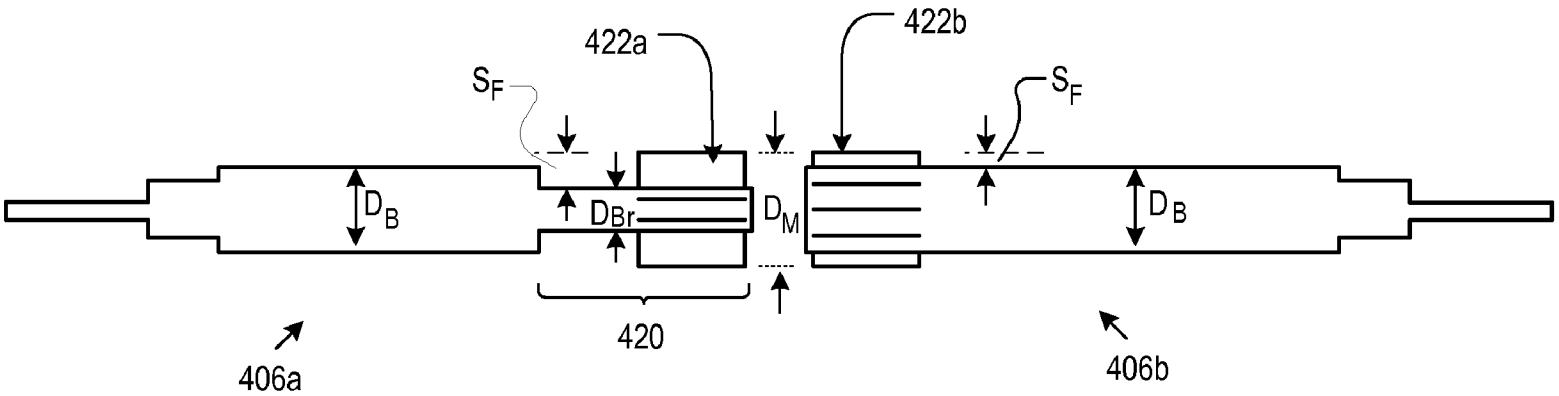
FIG. 4 depicts a comparison two anti-torpedo projectiles in accordance with the illustrative embodiment of the present invention, wherein one of the projectiles has a reduced tail diameter, enabling an increase in fin span relative to the other projectile.

As depicted in FIG. 4, the maximum diameter $D_M$ for each projectile, which is measured to the outer edge of diametrically-opposed fins, is the same. Likewise, the diameter $D_B$ of the forward portion of the two projectiles is the same. But the diameter of the tail section of the projectiles is not the same; in particular, projectile 406*a* has a reduced body diameter $D_{Br}$ near tail section 420. By virtue of this smaller diameter, the fin span $S_F$ of fins 422*a* of projectile 406*a* can be and is greater than the fin span $S_F$ of fins 422*b* of projectile 406*b*. This approach can be used to satisfy a need for a somewhat greater fin span, as might be desired as a function of aerodynamic or other considerations, than would otherwise be dictated by cavity-running requirements.

As previously indicated, the center of gravity of projectile 106 should be situated as far forward as possible to prevent the in-water projectile from overturning. This is addressed, in some embodiments, via two different materials of construction. In particular, a relatively more dense material is used for the nose, etc., and a relatively less dense material is used for the body. For example, in some embodiments, the nose comprises tungsten and the body comprises bronze. In some other embodiments, the nose is tungsten and the body comprises aluminum. In yet some further embodiments, the nose comprises tungsten and the body comprises titanium. In some additional embodiments, the nose and body comprise S-7 steel. In some embodiments, the projectile comprises a back that is at least partially "hollowed out." The removal of material from the aft section of the projectile serves to keep its center of gravity forward.

The design guidelines described above provide a starting point for a deck launched, anti-torpedo projectile design. The design proceeds with a proposal based on a stepped profile. The proposed design must then be vetted via computational fluid dynamic simulations and stress analyses, as is known to those skilled in the art. FIGS. 5-18 depict five embodiments of an anti-torpedo projectile design in accordance with the present teachings. It has been shown through experimentation that projectiles having lengths within the range of approximately 4 inches to approximately 9 inches and diameters within the range of approximately 0.5 inch to approximately 2 inches have beneficial performance characteristics. It should be noted, however, that these dimensions are merely representative and are not intended to limit the present invention.

Turning now to FIGS. 5 through 8, a first embodiment of an anti-torpedo projectile in accordance with the illustrative embodiment of the present invention is shown. As depicted in these Figures, in particular FIG. 5, projectile 506 comprises a plurality of substantially right-circular cylindrical sections 530 that make up the nose section. Tip 532 of the nose is flat, as is required to create the cavitation phenomena. The gradual increase in diameter of the cylindrical sections defines a geometry that remains completely within the bounds of the cavity formed by the blunt nose face. It also prevents the projectile from pitching down (i.e., overturning) during water entry. The aft section of projectile 506 includes region 520, which has a reduced diameter relative to the forward portion of the projectile's body. This enables an increase in the fin span of fins 522.

Figure 6:
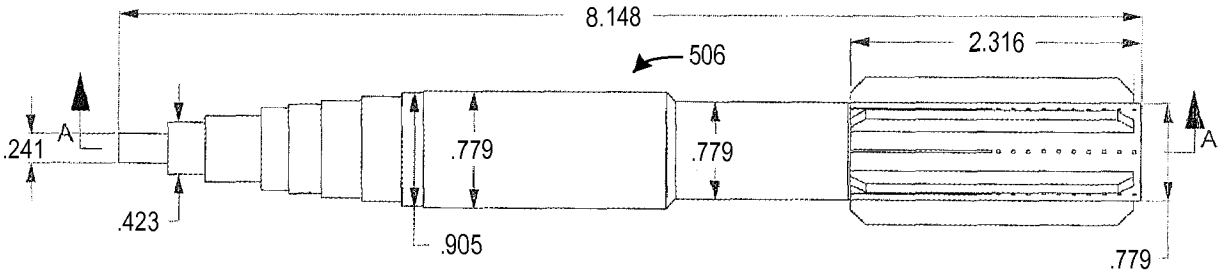
FIGS. 5 through 8 depict a first embodiment of an anti-torpedo projectile in accordance with the illustrative embodiment of the present invention.
Figure 7:
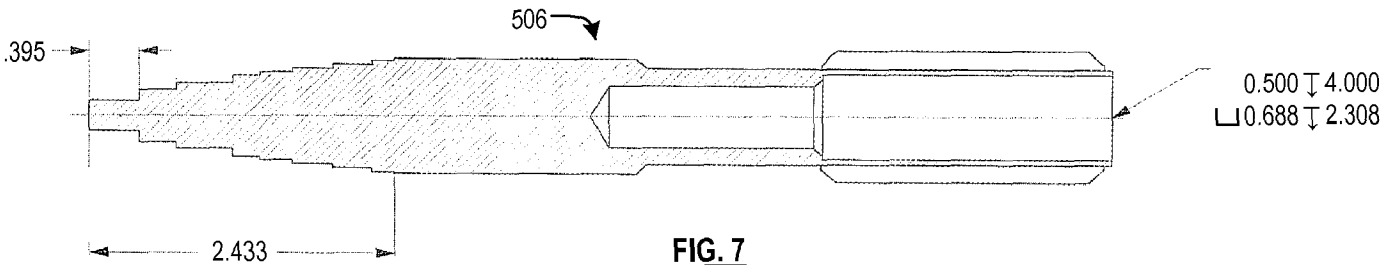
Figure 8:
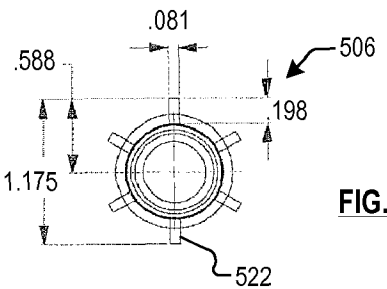
Figure 5:
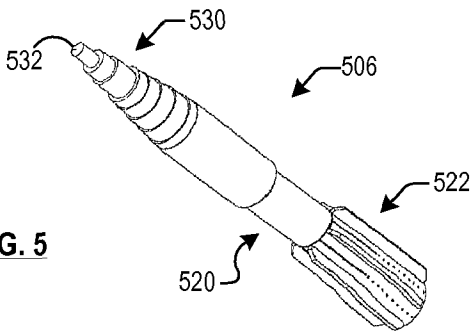

FIG. 6 depicts a side view of projectile 506 and shows the diameters of the various cylindrical sections, as well as the chord length of the tail fins. FIG. 7, which is a cross section along the line A-A in FIG. 6 in the direction shown, depicts the lengths of the various cylindrical sections of projectile 506. FIG. 8 depicts a tail end view of projectile 506 and shows some additional dimensions pertinent to fins 522.

FIGS. 9 through 12 depict a second embodiment of an anti-torpedo projectile in accordance with the illustrative embodiment of the present invention. As depicted in these Figures, in particular FIG. 9, the nose of projectile 906 comprises only three cylindrical sections 930. Unlike projectile 506, the aft section of projectile 906 is not reduced in diameter. As a consequence, fins 922 have a relatively shorter span than could otherwise be the case.

Figures 9, 10, 11, 12:
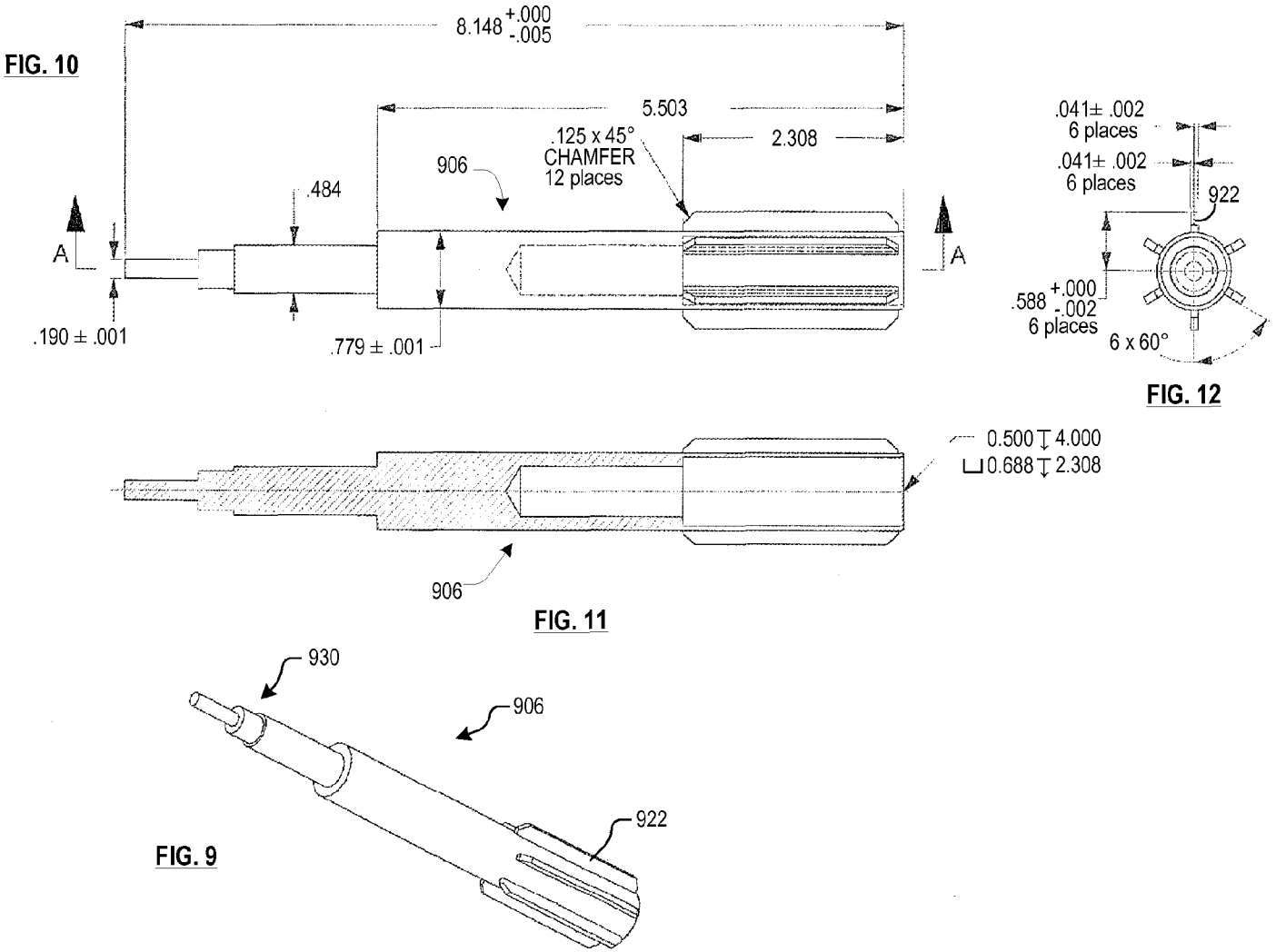
FIGS. 9 through 12 depict a second embodiment of an anti-torpedo projectile in accordance with the illustrative embodiment of the present invention.

FIG. 10 is a side view that depicts various dimensions of projectile 906. FIG. 11 is a cross section along the line A-A of FIG. 10 in the direction shown. FIG. 12 depicts a tail end view of projectile 906 and shows some additional dimensions pertinent to fins 922.

FIGS. 13 through 16 depict a third embodiment of an anti-torpedo projectile in accordance with the illustrative embodiment of the present invention. As depicted in these Figures, in particular FIG. 13, projectile 1306 comprises a nose having two cylindrical sections 1330 and body portion 1340 that is shaped as a right circular cone. Body portion 1340 comprises a taper angle that is less than the minimum intended water entry angle, in this case 3.5 degrees. Like projectile 906, the aft portion of the body is not reduced in diameter. Projectile 1306 includes a plurality of fins 1322.

Figure 14:
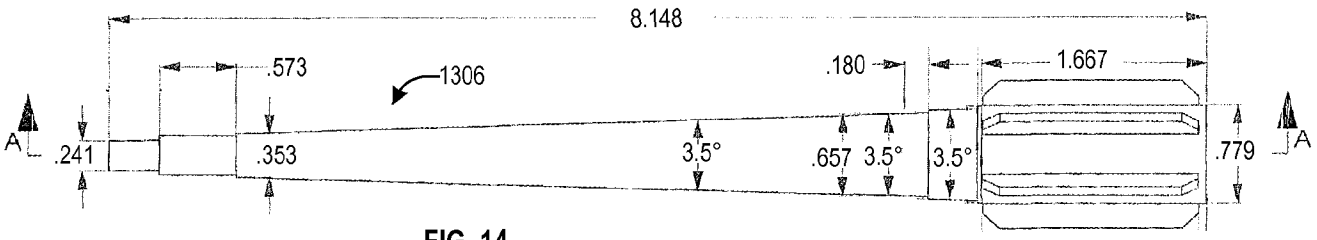
FIGS. 13 through 16 depict a third embodiment of an anti-torpedo projectile in accordance with the illustrative embodiment of the present invention.
Figure 15:
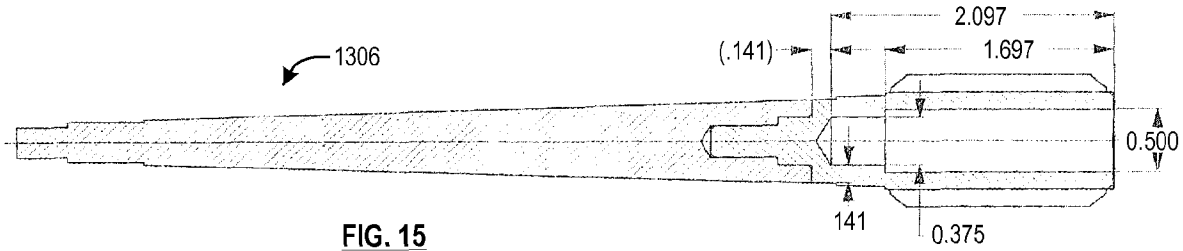
Figure 16:
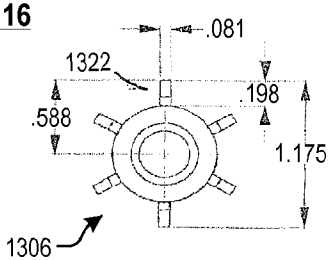
Figure 13:
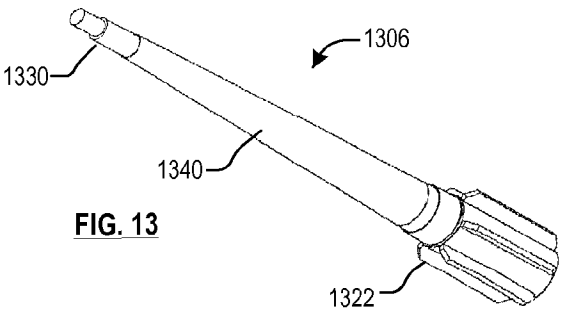

FIG. 14 is a side view that depicts various dimensions of projectile 1306. FIG. 15 is a cross section along the line A-A of FIG. 14 in the direction shown. FIG. 15 depicts the multipiece construction of projectile 1306. In some embodiments, the forward section will be formed of a relatively denser material to site the center of gravity of projectile 1306 relatively forward. FIG. 16 depicts a tail end view of projectile 1306 and shows some additional dimensions pertinent to fins 1322.

Figure 17:
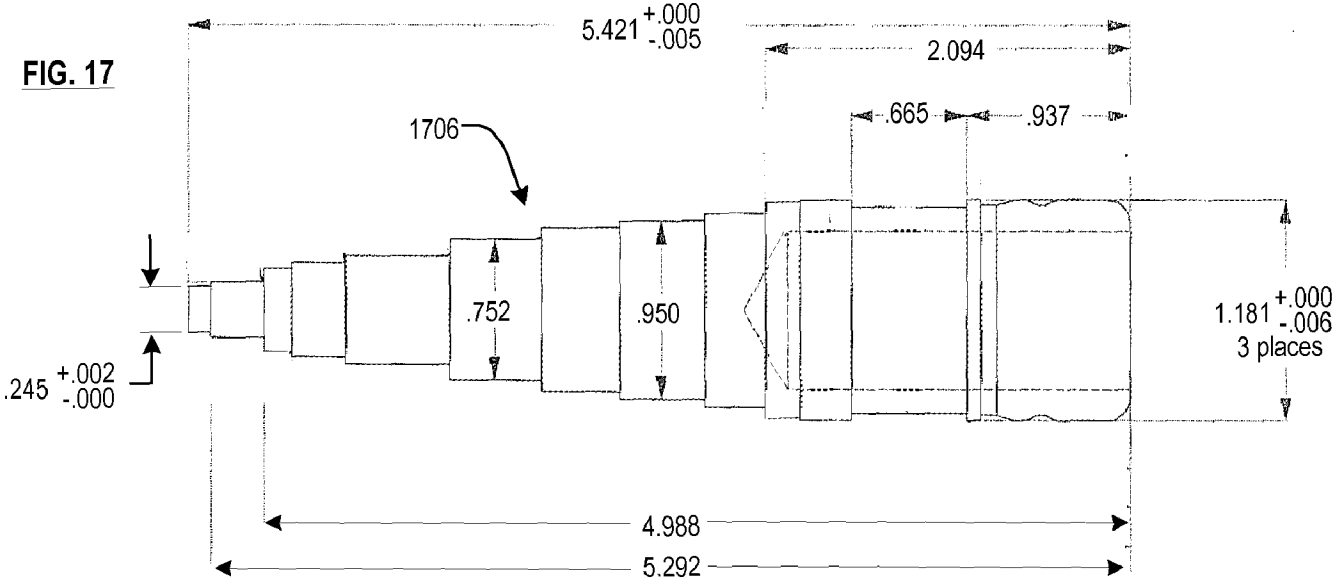
FIGS. 17 and 18 depict a fourth embodiment of an anti-torpedo projectile in accordance with the illustrative embodiment of the present invention.
Figure 18:
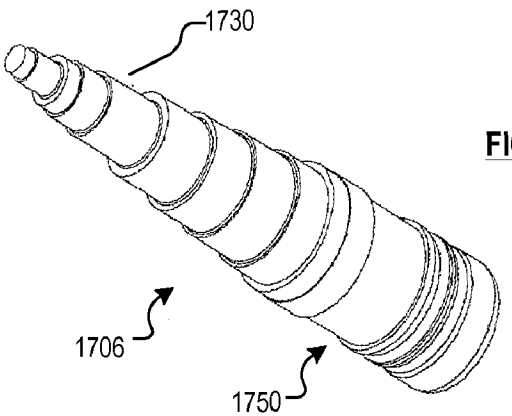

FIGS. 17 and 18 depict a fourth embodiment of an anti-torpedo projectile in accordance with the illustrative embodiment of the present invention. As depicted in these Figures, projectile 1706 is a spin-stabilized projectile. That is, it does not include tail fins. As a consequence, it would be fired from a rifled barrel to impart spin so as to maintain in-air stability.

As depicted in FIG. 17, projectile 1706 comprises a plurality of cylindrical sections 1730. Tail section 1750 is relatively short and has a slightly reduced diameter. In some embodiments, this reduced diameter accommodates installation of a rifling band (to mate with the rifling of the barrel and provide spin) and an obturator (to seal the gap between projectile outer diameter and barrel inner diameter). As depicted in FIG. 18, which is a side view of projectile 1706, the maximum diameter of projectile 1706 is very similar to that of the maximum diameter of fin-stabilized projectiles 506, 906, and 1306.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A projectile that is physically adapted to travel through air, penetrate water, and travel under water in a cavity-running mode, comprising:

a body; and a nose depending from the body, wherein:

(a) the nose has a blunt forward end suitable for providing a cavity running mode at sufficient velocity;

(b) the nose comprises a plurality of discrete, right-circular cylindrical sections of increasing diameter that define a stepped profile thereof; and (c) a center-of-gravity of the projectile is forward of a midpoint thereof.

2. The projectile of claim 1 wherein a taper angle of the stepped profile of the nose, as results from the increasing diameter of the right-circular sections, is no greater than a grazing angle at which the projectile is to enter water.

3. The projectile of claim 1 wherein the nose further comprises a right-circular conic section.

4. The projectile of claim 1 wherein a taper angle of the conic section is no greater than a grazing angle at which the projectile is to enter water.

5. The projectile of claim 1 further comprising at least six tail fins, wherein the tail fins provide suitable fin surface for stable in-air flight, and wherein a height of the tail fins is suitably short so that the tail fins remain within an ellipsoidal cavity that defines a supercavitating region.

6. The projectile of claim 5 wherein the tail fins have a substantially constant span along a chord thereof.

7. The projectile of claim 1 wherein the body comprises (a) a forward portion, and (b) an aft portion having a length, wherein at no point along the length of the aft portion is a diameter thereof as large as a diameter of the forward portion.

8. The projectile of claim 7 wherein the diameter of the aft portion is constant.

9. The projectile of claim 7 further comprising tail fins, wherein the tail fins are disposed on the aft portion of the body.

10. A projectile that is physically adapted to travel through air, penetrate water, and travel under water in a cavity-running mode, comprising:

a body; and a nose depending from the body, wherein:

(a) the nose has a blunt forward end suitable for providing a cavity running mode at sufficient velocity;

(b) the nose comprises a plurality of discrete, right-circular cylindrical sections of increasing diameter that define a stepped profile thereof; and tail fins, wherein the tails fins have shorter span and a longer chord relative to a span and a chord of a conventional tail fin that is designed based on aerodynamic or hydrodynamic considerations and without regard to cavity-running mode considerations.

11. The projectile of claim 10 wherein the projectile comprises at least six of the tail fins.

12. The projectile of claim 10 wherein a taper angle of the stepped profile of the nose, as results from the increasing diameter of the right-circular sections, is no greater than a grazing angle at which the projectile is to enter water.

13. The projectile of claim 10 wherein the nose further comprises a right-circular conic section aft of the right-circular cylindrical sections.

14. The projectile of claim 10 wherein the body comprises a forward portion, and an aft portion having a length, wherein at no point along the length of the aft portion is a diameter thereof as large as a diameter of the forward portion.

15. The projectile of claim 14 wherein the tail fins are disposed on the aft portion.

16. The projectile of claim 10 wherein the tail fins have a substantially constant span along a chord thereof.

17. A projectile that is physically adapted to travel through air, penetrate water, and travel under water in a cavity-running mode, comprising:

a nose, wherein the nose has a blunt forward end suitable for providing a cavity running mode at sufficient velocity;

a body, wherein the body comprises a forward portion and an aft portion, wherein a diameter of an external surface of the projectile decreases at the aft portion relative to the forward portion; and tail fins, wherein the tail fins are disposed on the aft portion of the body where the diameter of the external surface of the projectile is decreased.

18. The projectile of claim 17 wherein the nose comprises a plurality of discrete, right-circular sections of increasing diameter that define a stepped profile thereof.

19. The projectile of claim 18 wherein the plurality of discrete sections comprises right-circular cylindrical sections.

20. The projectile of claim 19 wherein the plurality of discrete sections further comprises a right-circular conic section.

* * * * *